US008912133B2

(12) United States Patent
Gieselman et al.

(10) Patent No.: US 8,912,133 B2
(45) Date of Patent: Dec. 16, 2014

(54) LUBRICATING COMPOSITION CONTAINING A POLYMER

(71) Applicant: The Lubrizol Corporation, Wickliffe, OH (US)

(72) Inventors: Matthew D. Gieselman, Wickliffe, OH (US); Friend L. Christopher, Willoughby, OH (US); Preston J. Adam, Mentor, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/076,530

(22) Filed: Nov. 11, 2013

(65) Prior Publication Data

US 2014/0066345 A1 Mar. 6, 2014

Related U.S. Application Data

(63) Continuation of application No. 12/741,440, filed as application No. PCT/US2008/082944 on Nov. 10, 2008, now Pat. No. 8,637,437.

(60) Provisional application No. 60/987,499, filed on Nov. 13, 2007.

(51) Int. Cl.
*C10L 1/22* (2006.01)
*C10M 143/04* (2006.01)

(52) U.S. Cl.
CPC ..... *C10M 143/04* (2013.01)
USPC ..... 508/454; 508/192

(58) Field of Classification Search
CPC ..... C10M 133/38
USPC ..... 508/192, 454
See application file for complete search history.

(56) References Cited

U.S. PATENT DOCUMENTS

| | | | |
|---|---|---|---|
| 3,341,542 | A | 9/1967 | LeSuer |
| 4,234,435 | A | 11/1980 | Meinhardt et al. |
| 4,863,623 | A | 9/1989 | Nalesnik |
| 5,264,140 | A | 11/1993 | Mishra et al. |
| 5,356,999 | A | 10/1994 | Kapuscinski et al. |
| 5,409,623 | A | 4/1995 | Mishra et al. |
| 6,030,930 | A | 2/2000 | Emert et al. |
| 6,107,257 | A | 8/2000 | Valcho et al. |
| 6,107,258 | A | 8/2000 | Esche, Jr. et al. |
| 6,117,825 | A | 9/2000 | Liu et al. |
| 2004/0235688 | A1 | 11/2004 | Locke et al. |

FOREIGN PATENT DOCUMENTS

| | | |
|---|---|---|
| AU | 36909/71 | 3/1972 |
| GB | 768701 | 2/1957 |
| GB | 1565627 | 4/1980 |
| WO | 2005087821 | 9/2005 |
| WO | 2006015130 | 2/2006 |

OTHER PUBLICATIONS

T. Kappe, W. Stadlbauer: "Isatoic Anhydrides and Their Uses in Heterocyclic Synthesis", Advances in Heterocyclic Chemistry, vol. 28, 1981, pp. 127-141, XP002545385 p. 137.
Corresponding PCT Publication No. WO 2009/064685 A3 published May 22, 2009.
Search Report of the Corresponding International Application No. PCT/US2008/082944 dated Sep. 10, 2009.
Written Opinion of the Corresponding International Application No. PCT/US2008/082944 dated Sep. 10, 2009.

*Primary Examiner* — Prem C Singh
*Assistant Examiner* — Francis C Campanell
(74) *Attorney, Agent, or Firm* — Michael F. Esposito, Esq.; David M. Shold, Esq.

(57) ABSTRACT

The invention provides a lubricating composition containing an oil of lubricating viscosity, an additive containing a polymeric backbone and at least one amino group. The invention further provides for the additive to have dispersant and/or dispersant viscosity modifying properties. The lubricating composition is suitable for lubricating an internal combustion engine.

10 Claims, No Drawings

LUBRICATING COMPOSITION CONTAINING A POLYMER

This application is a continuation application of U.S. Ser. No. 12/741,440 filed on 9 Aug. 2010, which claims priority to a U.S. provisional application U.S. Ser. No. 60/987,499 filed on 13 Nov. 2007.

FIELD OF INVENTION

The invention provides a lubricating composition containing an oil of lubricating viscosity, and an additive containing a polymeric backbone and at least one amino group. The invention further provides for the additive to have dispersant and/or dispersant viscosity modifying properties. The lubricating composition is suitable for lubricating an internal combustion engine.

BACKGROUND OF THE INVENTION

Engine manufacturers have focused on improving engine design in order to minimise emissions of particulate emissions, emissions of other pollutants, cleanliness and also improve fuel economy and efficiency. One of the improvements in engine design is the use of exhaust gas recirculation (EGR) engines. Whilst improvements in engine design and operation have contributed, improved formulation of engine oil lubricants may also increase cleanliness and minimise engine deposits which accumulate when the engines are running. However, a number of engine design enhancements have led to increased formation and/or accumulation of soot and sludge.

Increased soot thickening is common in heavy duty diesel engines. Some diesel engines employ EGR. The soot formed in an EGR engine has different structures and causes increased viscosity of engine lubricant at lower soots levels than formation of soot in the engine without an EGR. Attempts to alleviate soot formation are disclosed in the references summarised below.

Traditional dispersant viscosity modifiers (DVMs) made from ethylene-propylene copolymers that have been radically grafted with maleic anhydride and reacted with various amines have shown desirable performance to prevent oil thickening in diesel engines. Aromatic amines are said to show good performance in this regard. DVMs of this type are disclosed in, for instance, U.S. Pat. Nos. 4,863,623; 6,107,257; 6,107,258; and 6,117,825.

U.S. Pat. No. 4,863,623 discloses controlling EGR soot by utilising maleic anhydride grafted ethylene-propylene copolymers capped with aromatic amines, such as 4-aminodiphenylamine.

U.S. Pat. No. 5,409,623 discloses functionalised graft copolymers as viscosity index improvers, containing an ethylene alpha-monoolefin copolymer grafted with an ethylenically unsaturated carboxylic acid material and derivatised with an azo-containing aromatic amine compound.

U.S. Pat. No. 5,356,999 discloses multifunctional viscosity index improvers for lubricating oils containing a polymer onto which has been grafted an unsaturated reactive monomer and thereafter reacted with amines containing sulphonamide units. The polymer is either an ethylene-propylene copolymer or an ethylene-propylene-diene terpolymer.

U.S. Pat. No. 5,264,140 discloses an ethylene alpha-monoolefin copolymer grafted with an ethylenically unsaturated carboxylic acid derivatised with an amide-containing aromatic amine material.

International publication WO 06/015130 discloses maleic anhydride grafted ethylene-propylene copolymers capped with sulphonamides, nitroanilines, diaromatic diazocompounds, anilides or phenoxyanilides. The copolymers are useful for controlling EGR soot.

Other dispersant viscosity modifying polymers suitable for lubricants have been contemplated including polyacrylic copolymers, including the disclosure of British Patent GB 768 701.

U.S. Pat. No. 4,234,435 discloses a composition in which a succinated polybutene is condensed with either an alkyl polyamine to make a succinimide dispersant or an alkyl polyol to make a succinic ester dispersant.

SUMMARY OF THE INVENTION

The inventors of the present invention have discovered that providing at least one of (i) a lubricating composition capable of reducing viscosity increase (often less than 12 $mm^2$/sec (cSt) at 100° C. at a soot loading of 6 weight % or more), and/or (ii) a lubricating oil composition maintain a relatively stable viscosity over a wide range of temperatures could be desirable because viscosity index improvers or DVMs may be employed to control viscosity over a wide temperature range and to control soot. Accordingly, it may also be desirable if a viscosity index improver were capable of achieving (i) and (ii).

The inventors of this invention have discovered that the lubricating composition is capable of providing at least one of (i) dispersancy, (ii) cleanliness and (iii) providing a lubricant with acceptable levels of soot thickening and/or sludge formation. Accordingly, it may also be desirable if an additive were capable for providing dispersant properties, and optionally providing a lubricant with acceptable levels of soot thickening and/or sludge formation.

In one embodiment the invention provides a lubricating composition comprising an oil of lubricating viscosity, and an additive represented by Formula (1):

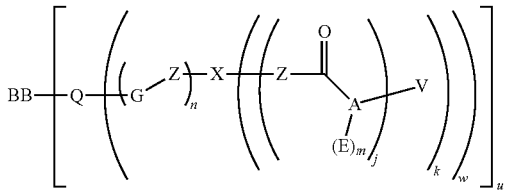

wherein

BB is a polymer backbone; (as is evident from the Formula, one or more groups contained within [ ]$_u$ will be attached to the backbone polymer);

G is -A-C(O)— or —C(O)-A-;

Q is either an imide or amide group, wherein Q is either (i) directly bonded to

G through a nitrogen atom of the imide or amide group, or (ii) bonded to G through a residue of a polyamine (Q may be entirely pendant from BB or partially embedded within the BB chain, such as in a backbone derived from an olefin-maleic anhydride copolymer or reactive equivalent thereof, said copolymer being at least partially reacted with an amine to form said amide or imide group);

A is an aromatic group;

E is independently a halogen, a nitro group, a carboxylic acid or ester, a sulphamide group, an amido group, or a hydrocarbyl group;

w is 1 to 10 or 1 to 5 or 1 to 3;

m is 0 to 6, or 0 to 4;

Z is independently —O—, —S—, or >$NR^1$, (typically —O— or >$NR^1$);

$R^1$ is independently hydrogen, or a hydrocarbyl group (for instance, containing 1 to 4 carbon atoms), although $R^1$ is typically hydrogen;

n is 1 to 10, 1 to 4, or 1 to 2;

k is 0 to 10, 0 to 3 or 0 to 1;

when k is non-zero, X is a hydrocarbyl group, and when k is zero, X is hydrogen or a hydrocarbyl group. The X group may also be a hydrocarbyl or hydrocarbylene group, respectively, containing at least one heteroatom, such as nitrogen, oxygen, or sulphur, e.g., derived from a polyamine;

V is independently —$NHR^2$, or -Q-BB;

$R^2$ is independently hydrogen or a hydrocarbyl group (for instance, containing 1 to 4 carbon atoms), although $R^2$ is typically hydrogen;

when k is not zero, j is 1 to 10, 1 to 4 or 1 to 2; and u is the number of pendant groups attached to the polymer backbone.

Typically, when G is -A-C(O)—, the additive may be other than a polyisobutylene succinimide.

Typically Q is directly bonded to A (as defined within the definition of G) through a nitrogen atom of the imide or amide group when BB-Q- is either a polyisobutylene succinimide, or other maleinated polymer backbone.

Typically, Q is bonded to A through a residue of a polyamine when BB-Q- is derived from a polyisobutylene succinimide and post-treated with a compound delivering a group represented by $(\ )_n$ of Formula (1).

Typically, when G is —C(O)-A-, the additive may be a post-treated product of a polyisobutylene succinimide.

In one embodiment the invention provides a lubricating composition comprising an oil of lubricating viscosity, and an additive represented by Formula (1) wherein k is 0 to 3, n is 1 to 4, $R^1$ is hydrogen, $R^2$ is hydrogen.

In one embodiment the additive represented by Formula (1) is

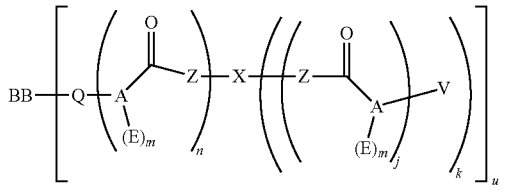

wherein each variable is defined above.

In one embodiment the invention provides a lubricating composition comprising an oil of lubricating viscosity, and an additive represented by Formula (1a):

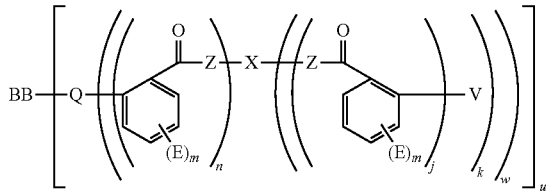

wherein BB, Q, G, E, m, w, Z, $R^1$, n, $R^2$, X, j, V, k and u are defined the same as in Formula (1).

In one embodiment the invention provides a lubricating composition comprising an oil of lubricating viscosity, and an additive represented by Formula (1b):

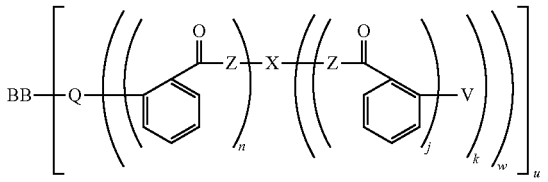

wherein BB, Q, Z, $R^1$, n, $R^2$, X, j, V, w, k and u are defined the same as in Formula (1).

In one embodiment the invention provides a method of lubricating an internal combustion engine comprising, supplying to the internal combustion engine the lubricating composition disclosed herein.

In one embodiment the invention provides for the use of the additive of Formula (1), or Formula (1a), or Formula (1b) as a dispersant or dispersant viscosity modifier in a lubricant.

In one embodiment the invention provides for the use of the additive of Formula (1), or Formula (1a), or Formula (1b) as a dispersant or dispersant viscosity modifier in an internal combustion engine lubricant.

DETAILED DESCRIPTION OF THE INVENTION

The present invention provides a lubricating composition and a method for lubricating an engine as disclosed above.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulphoxy);

(iii) hetero substituents, that is, substituents which, while having a predominantly hydrocarbon character, in the context of this invention, contain other than carbon in a ring or chain otherwise composed of carbon atoms; and (iv) heteroatoms include sulphur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Compound of Formulae (1), (1a) and (1b)

The polymer backbone may be a homopolymer or a copolymer, provided that it contains at least one carboxylic acid functionality or a reactive equivalent of carboxylic acid functionality (e.g., anhydride or ester). The carboxylic acid functionality or a reactive equivalent of carboxylic acid functionality is defined within Formula (1) as Q. The polymer backbone may have the carboxylic acid functionality (or a reactive equivalent of carboxylic acid functionality) grafted onto the backbone, within the polymer backbone or as a terminal group on the polymer backbone.

In Formula (1) the BB-Q- unit may be derivable from, for instance, polyisobutylene succinic anhydride, maleic anhydride-styrene copolymers, esters of maleic anhydride-styrene copolymers, (alpha-olefin maleic anhydride) copolymers; maleic anhydride-grafted styrene-ethylene-alpha olefin polymers; polymethacrylates; polyacrylates; polyhydroxycarboxylic acids (including polyhydroxystearic acid); maleic anhydride graft copolymers of (i) hydrogenated alkenyl aryl conjugated diene copolymers (in particular hydrogenated copolymers of styrene-butadiene), (ii) polyolefins grafted with maleic anhydride (in particular ethylene-propylene copolymers), or (iii) hydrogenated isoprene polymers (in particular hydrogenated styrene-isoprene polymers); or mixtures thereof.

Examples of a suitable polymeric backbone to represent BB of Formula (1) include polymethacrylates or polyacrylates, polyisobutylenes, hydrogenated copolymers of styrene-butadiene, isobutylene-isoprene copolymers, ethylene alpha-monoolefin copolymers such as ethylene-propylene copolymers, polyisobutenes, hydrogenated styrene-isoprene polymers, hydrogenated isoprene polymers, hydrogenated alkenyl aryl conjugated diene copolymers, polyolefins, maleic anhydride-styrene copolymers (or esters of maleic anhydride-styrene copolymers thereof), or (alpha-olefin maleic anhydride) copolymers, or mixtures thereof. In one embodiment BB-Q- is derived from a polyisobutylene succinic anhydride, or mixtures thereof.

For polymethacrylates or polyacrylates, the carboxylic acid group is defined within Q of Formula (1).

For copolymers containing the maleic anhydride units within the backbone of the polymer (often referred to as interpolymers or alternating copolymers) e.g., maleic anhydride-styrene copolymers, or (alpha-olefin maleic anhydride) copolymers, the maleic anhydride unit is defined within Q of Formula (1).

The polymer backbones described herein are known in lubricant technology. For example:

(i) maleic anhydride and styrene-containing polymers are known from U.S. Pat. No. 6,544,935;

(ii) styrene-ethylene-alpha olefin polymers are taught in International publication WO 01/30947;

(iii) copolymers derived from isobutylene and isoprene have been used in preparing dispersants and are reported in International publication WO 01/98387;

(iv) styrene-butadiene and styrene-isoprene copolymers are described in a number of references including DE 3,106,959; and U.S. Pat. Nos. 5,512,192, and 5,429,758;

(v) polyisobutylene succinic anhydrides have been described in numerous publications including U.S. Pat. Nos. 4,234,435; and 3,172,892;

(vi) ethylene-propylene copolymers have been described in U.S. Pat. Nos. 4,632,769; 4,517,104; and 4,780,228;

(vii) (alpha-olefin maleic anhydride) copolymers have been described in U.S. Pat. No. 5,670,462;

(viii) polymethacrylates and polyacrylates are described in Neudoerfl, P., $5^{th}$ International Colloquim, additives for Lubricants and Operational Fluids, Volume 11, sections 8.2-1 to 8, 2-15; and (ix) polyhydroxycarboxylic acids have been described in European Patent Application 1 752 516.

Many of the polymer backbones are also described in "Chemistry and Technology of Lubricants, Second Edition, Edited by R. M. Mortier and S. T. Orszulik Published by Blackie Academic & Professional. In particular pages 144-180 discuss many of the polymer backbones (i)-(iv) and (vi)-(ix). The chemistry of (v) is described in more detail in pages 86 to 90.

The polymer backbone (other than a polyisobutylene) of the present invention may have a number average molecular weight (by gel permeation chromatography, polystyrene standard), which may be up to 150,000 or higher, e.g., 1,000 or 5,000 to 150,000 or to 120,000 or to 100,000. An example of a suitable number average molecular weight range includes 10,000 to 50,000, or 10,000 to 15,000, or 30,000 to 50,000. In one embodiment, the polymer backbone has a number average molecular weight of greater than 5,000, for instance, greater than 5000 to 150,000. Other combinations of the above-identified molecular weight limitations are also contemplated.

When the polymer backbone of the invention is a polyisobutylene number average molecular weight (by gel permeation chromatography, polystyrene standard), may be 350 to 5000, or 550 to 3000 or 750 to 2500. Commercially available polyisobutylene polymers have a number average molecular weight of 550, 750, 950-1000, 1650, or 2250.

In one embodiment A is an aromatic group containing 1 to 6, or 1 to 4, or 1-2, or just 1 six-membered ring. When A is a six-membered ring, the ring is either a substituted phenyl (represented by Formula 1a) or a phenyl (represented by Formula (1b). In one embodiment A is phenyl.

Formulae (1) and (1a) may contain a group represented by E. The definition of E includes a halogen such as chlorine, bromine, iodine or fluorine. Typically, when E is a halogen, E is chlorine. In one embodiment E is not a halogen.

Other suitable groups within the definition of E include a nitro group, a carboxylic acid or ester, a sulphamide group, an amido group, or a hydrocarbyl group. The hydrocarbyl group typically includes $C_{1-4}$-alkyl or optionally substituted aromatic groups. The optionally substituted aromatic groups typically include benzyl, phenyl or naphthyl.

When m is zero, the aromatic ring is unsubstituted, and E is replaced by hydrogen to satisfy the valence of the aromatic carbon atoms. Formula (1b) represents an additive when E is replaced by hydrogen to satisfy the valence of the aromatic carbon atoms.

The group -Q-G-Z—, may be derivable from an anthranilic anhydride, or a substituted anthranilic anhydride (when m is not zero in formula (1)). An example of a suitable anthranilic anhydride is isatoic anhydride, 8-methyl isatoic anhydride, 8-ethyl isatoic anhydride, 8-propyl isatoic anhydride, 8-butyl isatoic anhydride, naphthylanthranilic anhydride, or mixtures thereof. In one embodiment Formula (1a) and Formula (1b) represent an additive derived from isatoic anhydride.

The compound of Formula (1) typically has the number of groups within $[\ ]_u$ is in the range of 1 to 2000, or 1 to 500, or 5 to 250, or 1 to 4.

In one embodiment the number of groups within $[\ ]_u$ is in the range of 1 to 5, and the polymeric backbone (BB) is a polyisobutylene.

In one embodiment the number of groups within $[\ ]_u$ is in the range of 5 to 250, and the polymeric backbone includes maleic anhydride-styrene copolymers, esters of maleic anhydride-styrene copolymers, (alpha-olefin maleic anhydride) copolymers; polymethacrylates; polyacrylates; polyhydroxycarboxylic acids; maleic anhydride graft copolymers of (i) hydrogenated alkenyl aryl conjugated diene copolymers, (ii) polyolefins grafted with maleic anhydride, or (iii) hydrogenated isoprene polymers; or mixtures thereof.

In one embodiment the number of groups within $[\ ]_u$ is in the range of 5 to 250, and the polymeric backbone includes polyolefins grafted with maleic anhydride, or mixtures thereof. The polyolefin may be an ethylene-propylene copolymer.

When k is equal to zero the hydrocarbyl group typically contains an aryl group and at least one heteroatom. The heteroatom may be nitrogen, sulphur, oxygen, or mixtures thereof. In one embodiment the heteroatom is nitrogen.

Z may be derivable from (i) an amine, wherein the amine contains a primary or secondary amino-group, (ii) an alcohol, (iii) an aminoalcohol, and (iv) a thiol, or (v) mixtures thereof. In one embodiment Z is derivable from an amine.

The amine may be a monoamine or a polyamine. The amine may be an aromatic amine or non-aromatic.

Examples of suitable polyamines include ethylenediamine, 1,2-diaminopropane, N-methylethylenediamine, N-tallow($C_{16}$-$C_{18}$)-1,3-propylenediamine, N-oleyl-1,3-propylenediamine, polyethylenepolyamines (such as diethylenetriamine, triethylenetetramine, tetraethylenepentamine and "polyamine bottoms" (or "alkylenepolyamine bottoms")). In one embodiment the polyamine includes polyalkylenepolyamines. An additive of Formula (1) derived from one of the polyamines is believed to have dispersant properties.

In general, alkylenepolyamine bottoms may be characterised as having less than two, usually less than 1% (by weight) material boiling below about 200° C. A typical sample of such ethylene polyamine bottoms obtained from the Dow Chemical Company of Freeport, Tex. designated "HPA-X™", or from Huntsman as "E-100™". These alkylenepolyamine bottoms may be prepared using an ethylene dichloride process.

The aromatic amine may be an amine having two linked aromatic moieties. By the term "aromatic moiety is meant to include both mononuclear and polynuclear groups. The aromatic amine will typically have an N—H group capable of condensing with the pendant carbonyl containing group derivable from Z.

The polynuclear groups may be of the fused type wherein an aromatic nucleus is fused at two points to another nucleus such as found in naphthyl or anthranyl groups. The polynuclear group may also be of the linked type wherein at least two nuclei (either mononuclear or polynuclear) are linked through bridging linkages to each other. These bridging linkages may be chosen from, among others known to those skilled in the art, alkylene linkages, ether linkages, ester linkages, keto linkages, sulphide linkages, polysulphide linkages of 2 to 6 sulphur atoms, sulphone linkages, sulphonamide linkages, amide linkages, azo linkages, and direct carbon-carbon linkages between the groups without any intervening atoms. Other aromatic groups include those with heteroatoms, such as pyridine, pyrazine, pyrimidine, and thiophene. Examples of the aromatic groups that are useful herein include the aromatic groups derived from benzene, naphthalene, and anthracene, preferably benzene. Each of these various aromatic groups may also be substituted by various substituents, including hydrocarbyl substituents.

The aromatic amine may, in general, contain one or more reactive (condensable) amino groups. A single reactive amino group is sometimes preferred. Multiple amino groups, as in the case of the above described N,N-dimethylphenylenediamines, may be useful as well, especially if they are reacted under relatively mild conditions so as to avoid excessive crosslinking or gellation of the additive.

In one embodiment the aromatic amine is derived from dye intermediates containing multiple aromatic rings linked by, for example, amide structures. Examples include materials of the general structure:

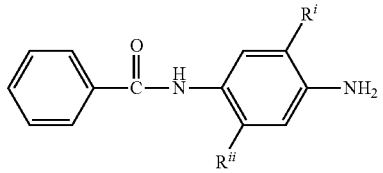

and isomeric variations thereof, where $R^i$ and $R^{ii}$ are independently alkyl or alkoxy groups such as methyl, methoxy, or ethoxy. In one instance, $R^i$ and $R^{ii}$ are both —$OCH_3$ and the material is known as Fast Blue RR [CAS#6268-05-9]. The orientation of the linking amido group may be reversed, to —NR—C(O)—.

In another instance, $R^{ii}$ is —$OCH_3$ and $R^i$ is —$CH_3$, and the material is known as Fast Violet B [99-21-8]. When both $R^i$ and $R^{ii}$ are ethoxy, the material is Fast Blue BB [120-00-3]. U.S. Pat. No. 5,744,429 discloses other aromatic amine compounds, particularly aminoalkylphenothiazines. N-aromatic substituted acid amide compounds, such as those disclosed in U.S. Patent Application 2003/0030033 A1, may also be used for the purposes of this invention. Suitable aromatic amines include those in which the amine nitrogen is a substituent on an aromatic carbocyclic compound, that is, the nitrogen is not $sp^2$ hybridized within an aromatic ring.

In one embodiment the aromatic amine may be an amine having two aromatic moieties linked by an —O— group. An example of such an amine is phenoxyphenylamine, also known as phenoxyaniline or aminophenyl phenyl ether, which may be represented by:

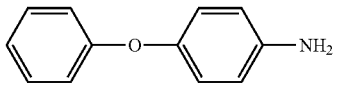

and its various positional isomers (4-phenoxy, 3-phenoxy, and 2-phenoxyaniline). Either or both of the aromatic groups may bear substituents, including hydrocarbyl, amino, halo, sulphoxy, hydroxy, nitro, carboxy, and alkoxy substituents. The amine nitrogen may be a primary amine nitrogen, as shown, or it may be secondary, that is, bearing a further substituent such as hydrocarbyl, preferably short chain alkyl such as methyl. In one embodiment, the aromatic amine is the unsubstituted material shown above.

The aromatic amine may be an amine having two aromatic moieties linked by an —N═N— group, an azo group. Such a material may be represented by the formula:

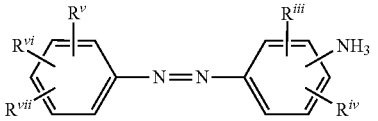

wherein each X is independently N or CH and the R groups are hydrogen or substituents as described above for the phenoxyphenylamine. Thus, each or $R^{iii}$ and $R^{iv}$ may be independently be H, —$NH_2$, hydrocarbyl or alkyl such as —$CH_3$, halo such as —Cl, sulphoxy such as —$SO_3H$, or —$SO_3Na$; and each of $R^v$, $R^{vi}$, and $R^{vi}$ is independently H, —OH, —$NO_2$, —$SO_3H$, carboxy such as —$CO_2Na$, or alkoxy such as —$OC_4H_9$. These materials are described in greater detail in U.S. Pat. No. 5,409,623, see column 4.

In one embodiment the azo-linked aromatic amine is represented by the formula:

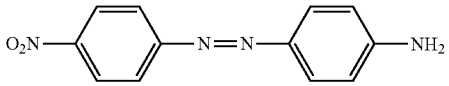

that is, 4-(4-nitrophenylazo)aniline, as well as positional isomers thereof. The material shown is commercially available as a dye known as Disperse Orange 3.

In one embodiment aromatic amine may be an amine having two aromatic moieties linked by a —C(O)O— group. Each group may be substituted as described above for the oxygen-linked and the azo-linked amines. In one embodiment this amine is represented by the formula:

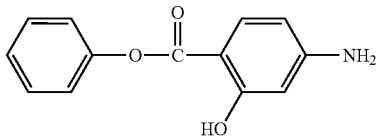

as well as positional isomers thereof. The material shown is phenyl-4-amino salicylate or 4-amino-2-hydroxy benzoic acid phenyl ester, which is commercially available.

In one embodiment the aromatic amine may be a diamine represented by the N,N-dialkylphenylenediamine formula:

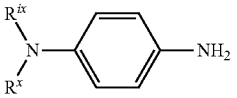

wherein $R^{ix}$ and $R^{x}$ may independently be hydrogen or a hydrocarbyl group (typically containing 1 to 6 carbon atoms).

An example of a particularly useful compound defines both $R^{ix}$ and $R^{x}$ as hydrogen (N,N-dimethyl-1,4-phenylenediamine).

In one embodiment the aromatic amine may be an amine having two aromatic moieties linked by an —$SO_2$— group. Each of the aromatic moieties may be substituted as described above for the oxygen-linked and the azo-linked amines. In one embodiment the linkage, in addition to —$SO_2$—, further contains an —NR— or specifically an —NH— group, so that the entire linkage is —$SO_2$NR— or —$SO_2$NH—. In one embodiment, this aromatic amine is represented by the formula:

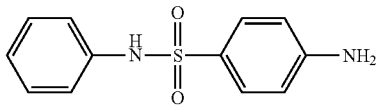

The structure as shown is that of 4-amino-N-phenyl-benzenesulphonamide. A commercially available variation thereof is sulphamethazine, or N'-(4,6-dimethyl-2-pyrimidinyl)sulphanilamide (CAS Number 57-68-1) which is believed to be represented by the formula:

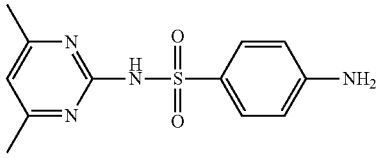

Sulphamethazine is commercially available.

The aromatic amine may be a nitro-substituted aniline, which, can, likewise, bear the substituents as described above for the oxygen-linked and the azo-linked amines. Included are the ortho-, meta-, and para-substituted isomers of nitroaniline. In one embodiment the amine is 3-nitro-aniline.

Examples of other suitable aromatic amines include amino-substituted aromatic compounds and amines in which the amine nitrogen is a part of an aromatic ring, such as 3-aminoquinoline, 5-aminoquinoline, and 8-aminoquinoline. Also included are aromatic amines such as 2-aminobenzimidazole, which contains one secondary amino group attached directly to the aromatic ring and a primary amino group attached to the imidazole ring. Other amines include N-(4-anilinophenyl)-3-aminobutanamide or 3-amino propyl imidazole, or 2,5-dimethoxybenzylamine.

The aromatic amine may also be an aminoquinoline. Commercially available materials include 3-aminoquinoline, 5-aminoquinoline, 6-aminoquinoline, and 8-aminoquinoline and homologues such as 4-aminoquinaldine.

The aromatic amine may also be an aminobenzimidazole such as 2-aminobenzimidazole.

The aromatic amine may also be a ring-substituted benzylamine, with various substituents as described above. One such benzyl amine is 2,5-dimethyoxybenzylamine.

Examples of particularly useful aromatic amines include aniline, N-alkylanilines such as N-methylaniline and N-butylaniline, di-(para-methylphenyl)amine, 4-aminodiphenylamine, N,N-dimethylphenylenediamine, naphthylamine, 4-(4-nitrophenylazo)aniline (disperse orange 3), sulphamethazine, 4-phenoxyaniline, 3-nitroaniline, 4-aminoacetanilide (N-(4-aminophenyl)acetamide)), 4-amino-2-hydroxy-benzoic acid phenyl ester (phenyl amino salicylate), N-(4-aminophenyl)-benzamide, various benzyl-amines such as 2,5-dimethoxybenzylamine, 4-phenylazoaniline, and substituted versions of these. Other examples include para-ethoxyaniline, para-dodecyl-aniline, cyclohexyl-substituted naphthylamine, and thienyl-substituted aniline.

Additional aromatic amines and related compounds are disclosed in U.S. Pat. Nos. 6,107,257 and 6,107,258; some of these include aminocarbazoles, benzoimidazoles, aminoindoles, aminopyrroles, amino-indazolinones, aminoperimidines, mercaptotriazoles, aminophenothiazines, aminopyridines, aminopyrazines, aminopyrimidines, pyridines, pyrazines, pyrimidines, aminothiadiazoles, aminothiothiadiazoles, and aminobenzotriaozles. Other suitable amines include 3-amino-N-(4-anilinophenyl)-N-isopropyl butanamide, and N-(4-anilinophenyl)-3-{(3-aminopropyl)-(cocoalkyl)amino}butanamide.

In one embodiment the aromatic amine may be useful as an antioxidant. Of particular importance in that regard are alkylated diphenylamines such as nonyldiphenylamine and dinonyldiphenylamine. To the extent that these materials will condense with the carboxylic functionality of the polymer chain, they are also suitable for use within the present invention. However, it is believed that the two aromatic groups attached to the amine nitrogen may lead to steric hindrance and reduced reactivity. Thus, suitable amines include those having a primary nitrogen atom (—$NH_2$) or a secondary nitrogen atom in which one of the hydrocarbyl substituents is a relatively short chain alkyl group, e.g., methyl. Among such aromatic amines are 4-phenylazoaniline, 4-aminodiphenylamine, 2-aminobenzimidazole, and N,N-dimethylphenylenediamine. Some of these and other aromatic amines may also impart antioxidant performance to the polymers, in addition to dispersancy and other properties.

The above-described aromatic amines may be used alone or in combination with each other. They can also be used in combination with additional, aromatic or non-aromatic, e.g., aliphatic, amines, which, in one embodiment, have 1 to 8 carbon atoms. Other aromatic amines can include such amines as aminodiphenylamine. These additional amines may be included for a variety of reasons. Sometimes it may be desirable to incorporate an aliphatic amine in order to assure complete reaction of the acid functionality of the polymer, in the event that some residual acid functionality may tend to react incompletely with the relatively more bulky aromatic amine. Alternatively, the aliphatic amine may replace a portion of a more costly aromatic amine, while maintaining the majority of the performance of the aromatic amine. Aliphatic monoamines include methylamine, ethylamine, propylamine and various higher amines. Diamines or polyamines may be used for this function, provided that, in general, they have only a single reactive amino group, that is, a primary or secondary group; and typically a primary group. Suitable examples of diamines include dimethylaminopropylamine, diethylaminopropylamine, dibutylaminopropylamine, dimethylaminoethylamine, diethylaminoethylamine, dibutylamino ethylamine, 1-(2-aminoethyl)piperidine, 1-(2-aminoethyl)-pyrrolidone, aminoethylmorpholine, and aminopropylmorpholine. The amount of such an amine is typically a minor amount compared with the amount of the aromatic amine, that is, less than 50% of the total amine present on a weight or molar basis, although higher amounts may be used, such as 70 to 130% or 90 to 110%. Exemplary amounts include 10 to 70 weight percent, or 15 to 50 weight percent, or 20 to 40 weight percent. Use of certain combinations of 4-phenoxyaniline with dimethylaminopropylamine within these ranges, for instance, provides particularly good performance in terms of soot suspension. In certain embodiments, the polymers may be functionalised with three or more different amines, for instance, with 3-nitroaniline, 4-(4-nitrophenylazo)aniline, and dimethylaminopropylamine.

In one embodiment the aromatic amine may be selected from the group consisting of xylylenediamine, aniline, 4-aminodiphenylamine, benzylamine, phenethylamine, 3,4-dimethoxyphenethylamine, 1,4-dimethylphenylenediamine, and mixtures thereof.

In one embodiment the aromatic amine may be selected from the group consisting of xylylenediamine, aniline, 4-aminodiphenylamine, 1,4-dimethyl-phenylenediamine, and mixtures thereof.

An additive of Formula (1) derived from one of the aromatic amines and from a polyisobutylene polymer backbone is believed to have dispersant properties. Examples of suitable structures of dispersant additives derived from aniline or 4-aminophenylamine may be represented by the formulae:

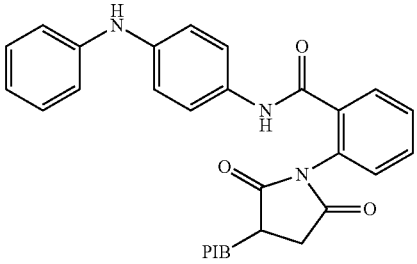

-continued

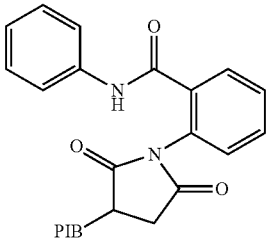

An additive of Formula (1) derived from one of the aromatic amines and from a non-polyisobutylene polymer backbone is believed to have dispersant viscosity modifying properties, and is particularly useful for soot control. Examples of suitable structures of DVM additives derived from aniline or 4-aminophenylamine may be represented by the formulae:

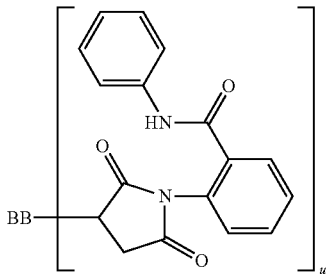

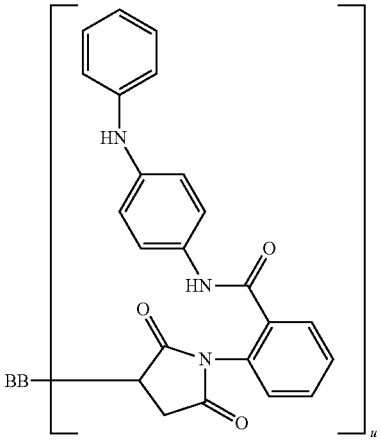

wherein BB is an ethylene-propylene copolymer and u is defined above. Additives of this type are believed to be derived from ethylene-propylene copolymers grafted with maleic anhydride and functionalised to form the imide group.

In one embodiment Z may be derivable from an aminoalcohol. The aminoalcohol may contain one or more hydroxyl groups and one or more amino groups. The aminoalcohol in different embodiments of this invention may contain 1 to 6 or 1 to 3 hydroxyl groups, 1 to 8 or 1 to 2 amino groups, and 2 to 50 or 2 to 40 or 2 to 25 or 2 to 15 carbon atoms. The aminoalcohol may be a monoalkanolamine, a dialkanolamine, a trialkanolamine or mixtures thereof. Examples of a suitable aminoalcohol may include ethanolamine, isopropanolamine, diethanolamine, triethanolamine, N,N-diethylethanolamine, N,N-dimethylethanolamine, N,N-dibutylethanolamine, 3-amino-1,2-propanediol, serinol, 2-amino-2-methyl-1,3-propanediol, tris(hydroxymethyl)-aminomethane, diisopropanolamine, N-methyldiethanolamine, 2-(2-aminoethylamino)ethanol, or mixtures thereof.

In one embodiment Z may be derivable from an alcohol. The alcohol may be a monohydric alcohol, a polyhydric alcohol, or mixtures thereof.

Examples of a suitable monohydric alcohol include methanol, ethanol, n-propanol, n-butanol, n-hexanol, n-octanol, n-decanol, n-dodecanol, n-tetradecanol, n-hexadecanol, n-octadecanol, isopropanol, isobutanol, tert-butanol, 2-ethylbutanol, 2-ethylhexanol, 3-heptanol, 3,5,5-trimethylhexanol, 3,7-dimethyloctanol and the so-called Guerbet alcohols such as those which are commercially available under the trade name Isofol (ex Condea GmbH) including mixtures thereof. Specific examples of Guerbet alcohols are Isofol 12, 14T, 16, 18T, 18E, 20, 24, 28, 32, 32T and 36.

Examples of a suitable polyhydric alcohol include ethylene glycol, propylene glycol, butylene glycol, pentaerthyritol, mannitol, sorbitol, glycerol, di-glycerol, tri-glycerol, tetraglycerol, erythritol, 2-hydroxymethyl-2-methyl-1,3-propanediol (trimethylolethane), 2-ethyl-2-(hydroxymethyl)-1,3-propanediol(trimethylolpropane), 1,2,4-hexanetriol, dihydroxypropanes, dihydroxybutanes, dihydroxypentanes, glycerine, trihydroxypropanes, trihydroxybutanes, trihydroxypentanes, glycerol, erythritol, 2-hydroxymethyl-2-methyl-1,3-propanediol(trimethylolethane), 2-ethyl-2-(hydroxymethyl)-1,3-propanediol (trimethylolpropane), 1,2,4-hexanetriol and mixtures thereof.

In one embodiment Z may be derivable from a thiol, or mixtures thereof. Examples of a suitable thiol include thioglycolic acid, thioethanol (2-mercapto ethanol), $C_{8-10}$-thiol alcohols, benzyl mercaptan, thiophenols, or mixtures thereof.

The process to prepare the additive of the present invention may be either a one pot reaction or a two-pot reaction.

In one embodiment the invention provides a lubricating composition comprising:

(a) an oil of lubricating viscosity; and (b) an additive obtained/obtainable by a process comprising reacting:

(1) an anthranilic anhydride;

(2) a polymer containing either:

(i) an anhydride group;

(ii) a carboxylic acid group; or (iii) an acyl group; and (3) at least one member of the group selected from (i) an amine, wherein the amine contains a primary or secondary amino-group;

(ii) an alcohol;

(iii) an aminoalcohol; and (iv) a thiol, to form the additive.

The process outlined may react (1), (2) and (3) in any order. When the process reacts (2) and (3) followed by reaction with (1), the product formed may be described as being post-treated with the anthranilic anhydride. Typically, post-treated products comprise a polyisobutylene succinimide that may be derived from a polyamine. A non-limiting reaction scheme for a post-treated product is:

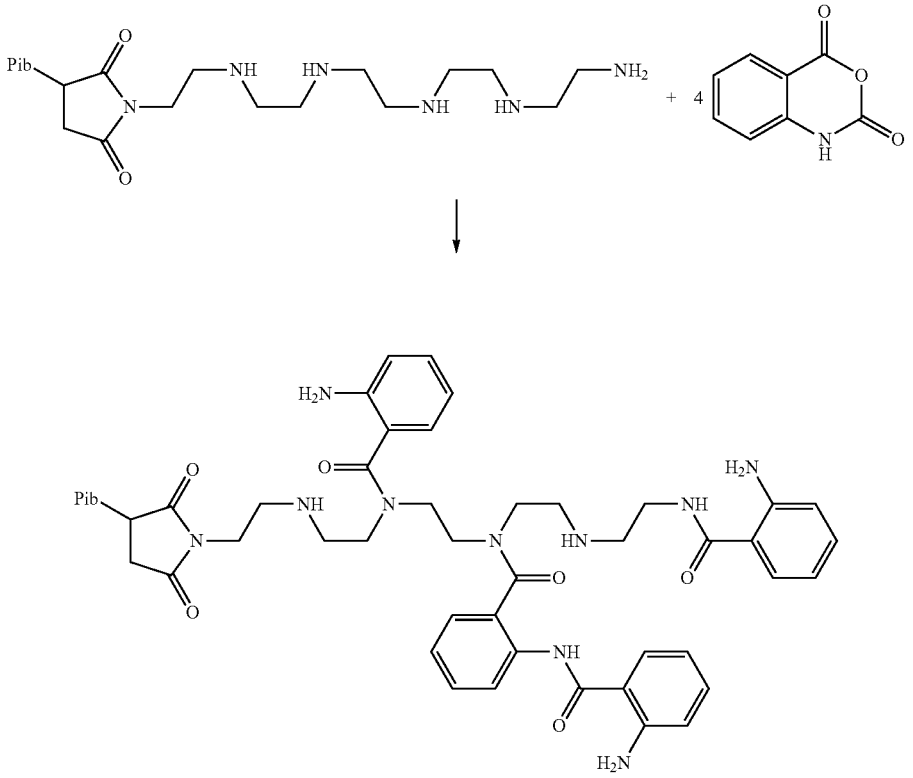

The nature of the polyisobutylene (Pib) may be the same as described above. A person skilled in the art will appreciate that although the product shown above shows four moles of isatoic anhydride reacting with the amine other products may be derived from one or two isatoic anhydride pendant groups. It is believed that where one mole of isatoic anhydride reacts with the polyisobutylene succinimide the reaction kinetically reacts with a primary amino group. The reaction scheme may be represented by:

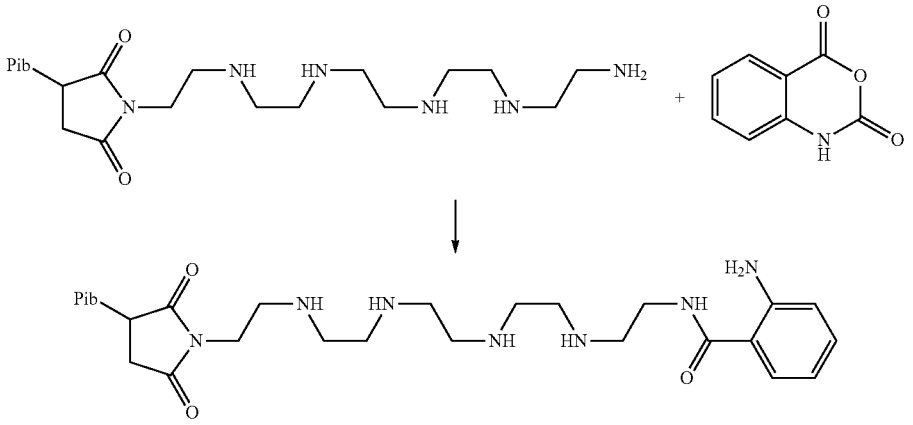

The reaction scheme above would also equally apply for the other polyalkylenepolyamines described above.

In one embodiment the invention provides a lubricating composition comprising:

(a) an oil of lubricating viscosity; and (b) an additive obtained/obtainable by a process comprising the steps of:

(1) reacting an anthranilic anhydride (typically isatoic anhydride) with either:

(i) an amine, wherein the amine contains a primary or secondary amino-group;

(ii) an alcohol;

(iii) an aminoalcohol; or (iv) a thiol, to form a product; and (2) reacting the product of step (1) with a polymer containing either:

(i) an anhydride group;

(ii) a carboxylic acid group; or (iii) an acyl group, to form the additive.

The process outlined above, may be considered to be either a one-pot or a two-pot process. A one-pot process typically charges all reactants into a vessel before forming a product. The two-pot process typically reacts (1) and (2) in a vessel before later reaction with (3). Irrespective of whether the reaction is performed by one-pot or two-pot process it is believed that the anthranilic anhydride initially reacts with the selected reactant from the amine, aminoalcohol, alcohol or thiol to form a product that reacts with the polymer.

The processes described above may be carried out at a reaction temperature in the range of 40° C. to 180° C., or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, or mixtures thereof.

The reaction may be preformed in either air or an inert atmosphere. Examples of suitable inert atmosphere include nitrogen or argon, typically nitrogen.

Oils of Lubricating Viscosity

The lubricating composition comprises an oil of lubricating viscosity. Such oils include natural and synthetic oils, oil derived from hydrocracking, hydrogenation, and hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulphides and the derivatives, analogs and homologs thereof or mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in the American Petroleum Institute (API) Base Oil Interchangeability Guidelines.

The five base oil groups are as follows: Group I (sulphur content >0.03 wt %, and/or <90 wt % saturates, viscosity index 80-120); Group II (sulphur content ≤0.03 wt %, and ≥90 wt % saturates, viscosity index 80-120); Group III (sulphur content ≤0.03 wt %, and ≥90 wt % saturates, viscosity index ≥120); Group IV (all polyalphaolefins (PAOs)); and Group V (all others not included in Groups I, II, III, or IV). The oil of lubricating viscosity comprises an API Group I, Group II, Group III, Group IV, and Group V oil or mixtures thereof. Often the oil of lubricating viscosity is an API Group I, Group II, Group III, Group IV oil or mixtures thereof. Alternatively the oil of lubricating viscosity is often an API Group II, Group III or Group IV oil or mixtures thereof.

The amount of the oil of lubricating viscosity present is typically the balance remaining after subtracting from 100 wt % the sum of the amount of the additive as described herein above, and the other performance additives.

The lubricating composition may be in the form of a concentrate and/or a fully formulated lubricant. If the lubricating composition of the invention is in the form of a concentrate (which may be combined with additional oil to form, in whole or in part, a finished lubricant), the ratio of the of components of the invention to the oil of lubricating viscosity and/or to diluent oil include the ranges of 1:99 to 99:1 by weight, or 80:20 to 10:90 by weight.

Other Performance Additives

The composition optionally comprises other performance additives. The other performance additives comprise at least one of metal deactivators, viscosity modifiers, detergents, friction modifiers, antiwear agents, corrosion inhibitors, dispersants (other than the additive of Formula (1) as disclosed herein), dispersant viscosity modifiers (other than the additive of Formula (1) as disclosed herein), extreme pressure agents, antioxidants, foam inhibitors, demulsifiers, pour point depressants, seal swelling agents and mixtures thereof. Typically, fully-formulated lubricating oil will contain one or more of these performance additives.

INDUSTRIAL APPLICATION

The additive of the invention may be added to a lubricant in a range of 0.01 wt % to 20 wt %, or 0.05 wt % to 10 wt %, or 0.08 wt % to 5 wt %, or 0.1 wt % to 3 wt % of the lubricating composition.

The lubricating composition may be utilised in an internal combustion engine. The internal combustion engine may or may not have an EGR.

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt % or less, 0.055 wt % or less, or 0.05 wt % or less. In one embodiment the phosphorus content may be 100 ppm to 1000 ppm, or 325 ppm to 700 ppm. The total sulphated ash content may be 2 wt % or less, or 1.5 wt % or less, or 1.1 wt % or less, or 1 wt % or less, or 0.8 wt % or less, or 0.5 wt % or less. In one embodiment the sulphated ash content may be 0.05 wt % to 0.9 wt %, or 0.1 wt % to 0.2 wt % to 0.45 wt %.

In one embodiment the lubricating composition is an engine oil, wherein the lubricating composition is characterised as having at least one of (i) a sulphur content of 0.5 wt % or less, (ii) a phosphorus content of 0.1 wt % or less, and (iii) a sulphated ash content of 1.5 wt % or less.

In one embodiment the lubricating composition is suitable for a 2-stroke or a 4-stroke marine diesel internal combustion engine. In one embodiment the marine diesel combustion engine is a 2-stroke engine. The ashless antiwear agent of the invention may be added to a marine diesel lubricating composition at 0.01 to 20 wt %, or 0.05 to 10 wt %, or 0.1 to 5 wt %.

The following examples provide illustrations of the invention. These examples are non-exhaustive and are not intended to limit the scope of the invention.

EXAMPLES

Preparative Example 1 (EX1)

1200 g of a polyisobutylene succinimide (the polyisobutylene has a number average molecular weight of about 2000, and an ethylene polyamine bottoms amine) and 23.8 g of diluent oil are charged into a vessel and heated to 155° C. Isatoic anhydride (32.6 g) is added portionwise and the vessel held at 155° C. for 4 hours. The resultant product is filtered, giving a product with a nitrogen content of 1.2 wt % and a yield of 1197 g.

Preparative Example 2 (EX2)

A solution of aminodiphenylamine in toluene is charged with isatoic anhydride such that the aminodiphenylamine and isatoic anhydride are in a 1:1 ratio, heated to reflux temperature under a nitrogen atmosphere, and stirred for 6 hours. After cooling the resultant product is isolated via filtration yielding a dark-blue powder.

Preparative Example 3 (EX3)

is prepared in a similar manner to EX2, except aniline is used as the reactive amine.

Preparative Example 4 (EX4)

is prepared in a similar manner to EX2, except N,N-dimethyl-benzene-1,4-diamine is used as the reactive amine.

Preparative Example 5 (EX5)

A solution of benzylamine in toluene is charged with isatoic anhydride, such that benzylamine and isatoic anhydride are in a 1:1 ratio, and stirred at room temperature under a nitrogen atmosphere for 2 hours. The product is isolated via filtration yielding an off-white powder.

Preparative Example 6 (EX6)

is prepared in a similar manner to EX5, except that phenethylamine is used as the reactive amine.

Preparative Example 7 (EX7)

A solution of aniline in toluene is charged with isatoic anhydride such that the aniline and isatoic anhydride are in a 1:1 ratio, heated to reflux temperature under a nitrogen atmosphere, and stirred for 3 hours. A second equivalent of isatoic anhydride is added and the reaction held at reflux temperature under a nitrogen atmosphere for 2 hours. After cooling the resultant product is isolated via filtration yielding an off-white powder.

Preparative Example 8 (EX8)

A 2-L, 4-neck flask equipped with an overhead stirrer, thermowell, subsurface inlet with nitrogen line, and Dean-Stark trap with condenser is charged with 3000 g conventional polyisobutylene succinic anhydride (polyisobutylene has a number average molecular weight of 2000) and 3507 g diluent oil and heated to 110 C. The product from EX2 (539 g) is added and the temperature increased to 155° C. and held for 6 hours. The product is filtered, giving a viscous oil with a nitrogen content of 1.07 wt % and a yield of 6629 g.

Preparative Example 9 (EX9)

A 2-L, 4-neck flask equipped with an overhead stirrer, thermowell, subsurface inlet with nitrogen line, and Dean-Stark trap with condenser is charged with 361 g direct alkylation polyisobutylene succinic anhydride (polyisobutylene has a number average molecular weight of 2200) and heated to 110 C. The product from EX2 (64 g) is added and the temperature increased to 150° C. and held for 4 hours. The product is filtered, giving a viscous oil with a nitrogen content of 1.9 wt %.

Preparative Example 10 (EX10)

A 2-L, 4-neck flask equipped with an overhead stirrer, thermowell, subsurface inlet with nitrogen line, and Dean-Stark trap with condenser is charged with 600 g conventional polyisobutylene succinic anhydride (polyisobutylene has a number average molecular weight of 2000) and 669 g diluent oil and heated to 110 C. The product from EX3 (75 g) is added and the temperature increased to 155° C. and held for 10 hours. The product is filtered, giving a viscous oil with a nitrogen content of 0.75 wt % and a yield of 1268 g.

Preparative Example 11 (EX11)

A 2-L, 4-neck flask equipped with an overhead stirrer, thermowell, subsurface inlet with nitrogen line, and Dean-Stark trap with condenser is charged with 381 g direct alkylation polyisobutylene succinic anhydride (polyisobutylene has a number average molecular weight of 2200) and heated to 110 C. The product from EX3 (29 g) is added and the temperature increased to 150° C. and held for 4 hours. The product is filtered, giving a viscous oil with a nitrogen content of 0.91 wt % and a yield of 403 g.

Preparative Example 12 (EX12)

A 2-L, 4-neck flask equipped with an overhead stirrer, thermowell, subsurface inlet with nitrogen line, and Dean-Stark trap with condenser is charged with 817 g direct alkylation polyisobutylene succinic anhydride (polyisobutylene has a number average molecular weight of 2200) and heated to 110 C. The product from EX4 (81 g) is added and the temperature increased to 150° C. and held for 4 hour The product is filtered, giving a viscous oil with a nitrogen content of 1.32 wt %.

Preparative Example 13 (EX13)

A 2-L, 4-neck flask equipped with an overhead stirrer, thermowell, subsurface inlet with nitrogen line, and Dean-Stark trap with condenser is charged with 480 g conventional polyisobutylene succinic anhydride (polyisobutylene has a number average molecular weight of 2000) and 547 g diluent oil and heated to 110 C. The product from EX5 (72 g) is added and the temperature increased to 155° C. and held for 4 hours. The product is filtered, giving a viscous oil with a nitrogen content of 0.87 wt % and a yield of 1027 g.

Preparative Example 14 (EX14)

A 2-L, 4-neck flask equipped with an overhead stirrer, thermowell, subsurface inlet with nitrogen line, and Dean-Stark trap with condenser is charged with 750 g conventional polyisobutylene succinic anhydride (polyisobutylene has a number average molecular weight of 2000) and 854 g diluent oil and heated to 110 C. The product from EX6 (114 g) is added and the temperature increased to 155° C. and held for 6 hours. The product is filtered, giving a viscous oil with a nitrogen content of 0.75 wt % and a yield of 1616 g.

Preparative Example 15 (EX15)

A 2-L, 4-neck flask equipped with an overhead stirrer, thermowell, subsurface inlet with nitrogen line, and Dean-Stark trap with condenser is charged with 923 g direct alkylation polyisobutylene succinic anhydride (polyisobutylene has a number average molecular weight of 2200) and heated to 110 C. The product from EX7 (112 g) is added and the temperature increased to 150° C. and held for 4 hours. The product is filtered, giving a viscous oil with a nitrogen content of 1.2 wt % and a yield of 928 g.

Preparative Example 16 (EX16)

A 2-L, 4-neck flask equipped with an overhead stirrer, thermowell, subsurface inlet with nitrogen line, and Dean-Stark trap with condenser is charged with 400 g ethylene-propylene copolymer grafted with maleic anhydride (commercially available as Lucant®A-5320H) and 941 g diluent oil and heated to 110° C. The product of EX2 (46 g) is added in one portion. The temperature is then raised to 160° C. and held at that temperature for 6 hours. The resultant product is filtered giving a viscous oil with a nitrogen content of 0.43 wt % and a yield of 1331 g.

Preparative Example 17 (EX17)

is prepared in a similar way to EX16, except 912 g diluent oil is charged and the product of EX3 (32 g) is used. The product has a nitrogen content of 0.31 wt % and a yield of 1289 g.

Preparative Example 18 (EX18)

is prepared in a similar way to EX16, except 917 g diluent oil is charged and the product of EX5 (34 g) is used. The product has a nitrogen content of 0.27 wt % and a yield of 1290 g.

Preparative Example 19 (EX19)

is prepared in a similar way to EX16, except 921 g diluent oil is charged and the product of EX6 (36 g) is used. The product has a nitrogen content of 0.31 wt % and a yield of 1296 g.

Preparative Example 20 (EX20)

A 2-L, 4-neck flask equipped with an overhead stirrer, thermowell, subsurface inlet with nitrogen line, and Dean- Stark trap with condenser is charged with isatoic anhydride (58 g), aminodiphenylamine (65 g), and diluent oil (351 g) and heated to 110° C. for 2 hour Polyisobutylene succinic anhydride (600 g) and diluent (351 g) oil is charged to the flask. Once the polyisobutylene succinic anhydride and diluent oil is completely added the reaction temperature is increased to 160° C. and held at that temperature for 10 hours. The resultant product is filtered giving a viscous oil with a nitrogen content of 1.1 wt % and a yield of 1300 g.

Preparative Example 21 (EX21)

A 2-L, 4-neck flask equipped with an overhead stirrer, thermowell, subsurface inlet with nitrogen line, and Dean-Stark trap with condenser is charged with isatoic anhydride (58 g), aniline (33 g), and diluent oil (334 g) and heated to 110° C. for 2 h then 130 for 2 hours. Polyisobutylene succinic anhydride (600 g) and diluent oil (334 g) is charged to the flask. Once the polyisobutylene succinic anhydride and diluent oil is completely added the reaction temperature is increased to 160° C. and held at that temperature for 10 hours. The resultant product is filtered giving a viscous oil with a nitrogen content of 0.64 wt % and a yield of 1236 g.

Preparative Example 22 (EX22)

A 2-L, 4-neck flask equipped with an overhead stirrer, thermowell, subsurface inlet with nitrogen line, and Dean-Stark trap with condenser is charged with isatoic anhydride (25 g), aminodiphenylamine (28 g), and diluent oil (762 g) and heated to 110° C. for 2 hours. An ethylene-propylene copolymer grafted with maleic anhydride (commercially available as Lucant®A-5320H) (375 g) and diluent oil (125 g) is charged to the flask. Once the copolymer and diluent oil is completely added the reaction temperature is increased to 160° C. and held at that temperature for 8 hours. The resultant product is filtered giving a viscous oil with a nitrogen content of 0.47 wt % and a yield of 1234 g.

Preparative Example 23 (EX23)

A 2-L, 4-neck flask equipped with an overhead stirrer, thermowell, subsurface inlet with nitrogen line, and Dean-Stark trap with condenser is charged with isatoic anhydride (25 g), aniline (14 g), and diluent oil (733.3) and heated to 110° C. for 4 hours. Ethylene-propylene copolymer grafted with maleic anhydride (375 g) and diluent oil (125 g) is charged to the flask. Once the copolymer and diluent oil is completely added the reaction temperature is increased to 160° C. and held at that temperature for 8 hours. The resultant product is filtered giving a viscous oil with a nitrogen content of 0.31 wt % and a yield of 1211 g.

Preparative Example 24 (EX24)

A 2-L flask is charged with 1238 g of a maleinated ethylene-propylene copolymer (80,000 Mn, 2.25 wt % maleic anhydride) dissolved in Group I diluent oil (87 wt %) containing butylated hydroxy toluene (0.1 wt %). The solution is warmed to 160° C. with stirring. The product from EX2 (13.2 g) is slurried in Surfonic® L24-5 surfactant (56.4 g) and charged to the reaction. The mixture is stirred at 160° C. for 16 hours. Dimethylaminpropylamine (0.7 g) is charged to the addition funnel and added drop-wise to the flask. The material is stirred at 160° C. for 1 hour. A polyisobutylene succinic anhydride product with diethylethanolamine (typically an aminoalkyl-ester salt) (19.9 g) is charged to the addition funnel and added drop-wise to the flask. The material is stirred at 160° C. for an additional hour. The product is isolated and cooled. The product contains 0.18 wt % nitrogen and the reaction yield is 1315 g.

Preparative Example 25 (EX25)

A 2-L is charged with 1000 g of a maleinated ethylene-propylene copolymer (80,000 Mn, 2.25 wt % maleic anhydride) dissolved in Group II diluent oil (85.4 wt %) containing butylated hydroxy toluene (0.1 wt %). The solution is warmed to 160° C. with stirring. The product from EX3 (9.3 g) is charged to the reaction. The mixture is stirred at 160° C. for 8 hours. Dimethylaminopropylamine (0.7 g) is charged to the addition funnel and added drop-wise to the flask. The material is stirred at 160° C. for 1 hour. The temperature is lowered to 115° C. and a polyisobutylene succinic anhydride product with diethylethanolamine (typically an aminoalkyl-ester salt) (17.8 g) is charged to the addition funnel and added drop-wise to the flask. The material is stirred at 115° C. for an additional 1 hour. Surfonic® L24-5 surfactant (17.8 g) is charged to the addition funnel and added drop-wise to the flask and the temperature maintained at 115° C. for 1 hour. Group II diluent oil (141 g) is charged to the addition funnel and added drop-wise to the flask at 115° C. and the material is stirred an additional 1 hour. The product is isolated and cooled. The product contains 0.14 wt % nitrogen and the reaction yield is 1152 g.

Rheology Test

A series of samples prepared above are evaluated in a drain oil rheology test. The samples are based on engine oil lubricants with low sulphur, phosphorous and ash content. The samples contain an amount of product from the preparative examples described above. The samples are analysed using the oscillation rheology test with a TA Instruments AR500™ rheometer in oscillation mode. The test geometry is a 40 mm flat top plate, and the sample is placed directly onto the flat variable temperature peltier plate of the rheometer. The samples are pre-sheared for 30 seconds at a shear stress of 0.080 Pa to ensure that all samples have a similar baseline shear history. The samples are allowed to equilibrate for 5 minutes before the oscillation test is initiated. The samples are equilibrated for a further 1 minute between each temperature step. Sample evaluation is performed with a temperature sweep test at a constant strain of 0.06, covering the temperature range of 40° C. to 150° C. with measurements taken at a total of 30 points. G' is the elastic, or storage modulus, and is defined in more detail in The Rheology Handbook, Thomas G. Mezger (edited by Ulrich Zoll), Published by Vincentz, 2002, ISBN 3-87870-745-2, p. 117. Generally, better results are obtained for samples with a lower G' value. The data obtained is shown in table 1. In table 1, COMP1 is a baseline sooted drain oil, G' ratio is calculated from a ratio of a $G'_{max}$ of each candidate species to that of the equivalent reference oil to provide a normalised measure of reduction in structure build-up.

In each case, the calculation of G' Ratio is made by comparison to a representative sooted drain oil. The sooted drain oil is analysed prior to each sample to allow G' ratio calculation.

The results obtained for the rheology screen test indicate that the additive of the invention reduces soot structure built-up relative to untreated drain oil.

TABLE 1

| Sample Containing Preparative Example | Treat Rate (wt % on actives basis) | G' Ratio |
|---|---|---|
| COMP1 | — | 1 |
| EX1 | 0.25 | 0.32 |
| EX1 | 0.5 | 0.17 |
| EX8 | 1 | 0.28 |
| EX8 | 2 | 0.12 |
| EX9 | 0.5 | 0.021 |
| EX9 | 0.75 | 0.0135 |
| EX9 | 1 | 0.011 |
| EX9 | 1.25 | 0.0091 |
| EX10 | 0.25 | 0.68 |
| EX10 | 0.5 | 0.84 |
| EX11 | 0.75 | 0.53 |
| EX11 | 1 | 0.26 |
| EX11 | 1.25 | 0.13 |
| EX12 | 0.75 | 0.25 |
| EX12 | 1 | 0.084 |
| EX12 | 1.25 | 0.021 |
| EX13 | 0.25 | 0.74 |
| EX13 | 0.5 | 0.77 |
| EX14 | 0.25 | 0.95 |
| EX14 | 0.5 | 0.81 |
| EX15 | 0.75 | 0.067 |
| EX15 | 1 | 0.041 |
| EX15 | 1.25 | 0.042 |
| EX16 | 1 | 0.038 |
| EX16 | 2 | 0.028 |
| EX17 | 1 | 0.17 |
| EX17 | 2 | 0.031 |
| EX18 | 1 | 0.2 |
| EX18 | 2 | 0.034 |
| EX19 | 1 | 0.19 |
| EX19 | 2 | 0.04 |
| EX21 | 0.25 | 0.72 |
| EX21 | 0.5 | 0.71 |

Comparative Study

The results obtained for EX11 are with a comparative example (COMP2) derived from reaction of the polyisobutylene succinic anhydride (of EX11) and aniline (in the absence of isatoic anhydride). Similar comparisons between EX9 and comparative example COMP3 (a product containing 4-aminodiphenylamine and not containing an isatoic anhydride group) are also presented. The comparative data obtained for is:

TABLE 2

| | Treat Rate of Additive | | |
|---|---|---|---|
| Example | 0.75 | 1 | 1.25 |
| | | G' Ratio | |
| EX11 | 0.53 | 0.26 | 0.13 |
| COMP2 | 1.12 | 1.16 | 1.2 |
| | | G' (Max) | |
| EX11 | 1.98 | 0.96 | 0.47 |
| COMP2 | 4.14 | 4.31 | 4.45 |
| | | G' Ratio | |
| EX9 | 0.0135 | 0.011 | 0.0091 |
| COMP3 | 0.2 | 0.14 | 0.035 |
| | | G' (Max) | |
| EX9 | 0.045 | 0.036 | 0.03 |
| COMP3 | 0.66 | 0.45 | 0.11 |

The comparative data demonstrates that the additive of the invention reduces soot structure built-up relative to comparative example not containing an anthranilic anhydride group.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising:

(a) an oil of lubricating viscosity; and (b) an additive obtained/obtainable by a process comprising reacting:

(1) isatoic anhydride;

(2) an ethylene α-monoolefin copolymer having a number average molecular weight of about 5,000 to about 120,000, said copolymer being grafted with maleic anhydride;

(3) at least one aromatic amine comprising at least two linked aromatic moieties, wherein the aromatic amine contains a primary or secondary amino-group;

to form the additive.

2. The lubricating composition of claim 1, wherein the aromatic amine comprises 4-aminodiphenylamine.

3. The process of claim 1, wherein isatoic anhydride and the aromatic amine are first reacted and the reaction product is subsequently reacted with the ethylene α-monoolefin copolymer to form the additive.

4. The process of claim 3, wherein the additive is further reacted with an aliphatic amine.

5. The lubricating composition of claim 1 wherein the ethylene a-monoolefin copolymer comprises an ethylene-propylene copolymer.

6. The lubricating composition of claim 1, wherein the additive is represented by the formula:

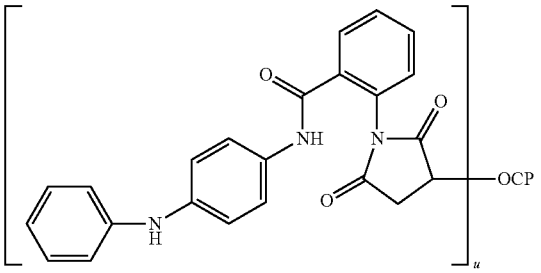

wherein OCP represents an ethylene/olefin copolymer and u is a number of 1 to about 250.

7. The lubricating composition of claim 1 characterised as having at least one of (i) a sulphur content of about 0.5 wt % or less, (ii) a phosphorus content of about 0.1 wt % or less, and (iii) a sulphated ash content of about 1.5 wt % or less.

8. A method of lubricating an internal combustion engine comprising, supplying to the internal combustion engine the lubricating composition of claim 1.

9. The method of claim 8, wherein the internal combustion engine is a heavy duty diesel engine.

10. The method of claim 8, wherein the lubricating composition is characterised as having at least one of (i) a sulphur content of about 0.5 wt % or less, (ii) a phosphorus content of about 0.1 wt % or less, and (iii) a sulphated ash content of about 1.5 wt % or less.

* * * * *